United States Patent [19]

Trage et al.

[11] Patent Number: 4,690,207

[45] Date of Patent: Sep. 1, 1987

[54] NATURAL-DRAFT COOLING TOWER WITH FORCED-DRAFT FLOW OVER REFLUX CONDENSERS

[75] Inventors: Burkhard Trage; Richard Leitz, both of Ratingen, Fed. Rep. of Germany

[73] Assignee: Balcke-Dürr Aktiengesellschaft, Ratingen, Fed. Rep. of Germany

[21] Appl. No.: 795,472

[22] Filed: Nov. 5, 1985

[30] Foreign Application Priority Data

Nov. 14, 1984 [DE] Fed. Rep. of Germany ..... 3441514

[51] Int. Cl.[4] ..... F28B 1/06; F28B 7/00

[52] U.S. Cl. ..... 165/113; 165/900; 165/912; 60/692

[58] Field of Search ..... 165/113, 912, 900, 137, 165/138; 60/690, 692, 693

[56] References Cited

U.S. PATENT DOCUMENTS

| | | | |
|---|---|---|---|
| 3,556,204 | 1/1971 | Dehne | 165/113 |
| 3,814,177 | 6/1974 | Harris et al. | 165/900 |
| 3,976,127 | 8/1976 | Harris | 165/900 |
| 4,159,738 | 7/1979 | Sedille | 165/900 |
| 4,164,256 | 8/1979 | Kelp | 165/137 |
| 4,190,102 | 2/1980 | Gerz | 165/113 |
| 4,580,401 | 4/1986 | Roscheweyh | 165/900 |

FOREIGN PATENT DOCUMENTS

| | | | |
|---|---|---|---|
| 1082286 | 5/1960 | Fed. Rep. of Germany | 165/113 |
| 3010816 | 9/1981 | Fed. Rep. of Germany | 165/900 |
| 3114948 | 1/1983 | Fed. Rep. of Germany | 165/113 |
| 2360043 | 3/1978 | France | 165/900 |
| 0085700 | 7/1981 | Japan | 165/900 |
| 0978067 | 3/1963 | United Kingdom | 165/900 |

OTHER PUBLICATIONS

Elonka Steve, "Air Cooled Heat Exchangers" *Power,* Nov. 1964, p. 181.

*Primary Examiner*—William R. Cline
*Assistant Examiner*—John K. Ford
*Attorney, Agent, or Firm*—Becker & Becker, Inc.

[57] ABSTRACT

A natural-draft cooling tower having a plurality of preferably roof-shaped heat exchange elements for condensing the turbine exhaust steam from a power plant. A portion of the heat exchange elements are connected to operate as condensers, and another portion of the heat exchange elements are connected to operate as dephlegmators, reflux condensers or fractionating columns, with the latter being disposed downstream, when viewed in the direction of flow of the steam, of the heat exchange elements that operate as condensers. In order to assure a complete condensation, and a residual condensation in the heat exchange elements that operate as reflux condensers, under all weather and load conditions, the heat exchange elements that operate as reflux condensers are each provided with a respective fan, the conveying capacity of which can be regulated.

2 Claims, 1 Drawing Figure

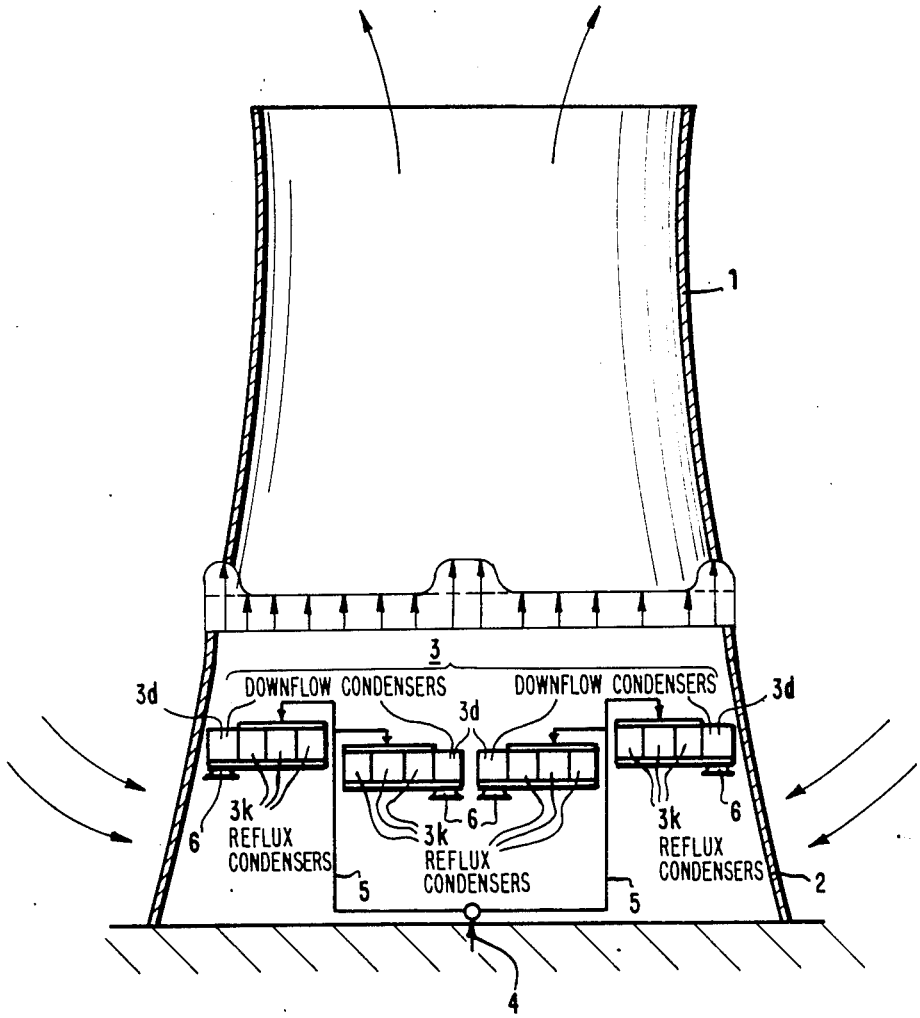
1
3
DOWNFLOW CONDENSERS
DOWNFLOW CONDENSERS
3d
3d
3d
3k
REFLUX
CONDENSERS
6
3k
REFLUX
CONDENSERS
6
3k
REFLUX
CONDENSERS
6
5
5
2
4

NATURAL-DRAFT COOLING TOWER WITH FORCED-DRAFT FLOW OVER REFLUX CONDENSERS

BACKGROUND OF THE INVENTION

1. Field of the Invention

The present invention relates to a natural-draft cooling tower having a plurality of preferably roof-shaped heat exchange elements for condensing the turbine exhaust steam from a power plant. A portion of the heat exchange elements are connected to operate as condensers, and another portion of the heat exchange elements are connected to operate as dephlegmators, reflux condensers or fractionating columns, with the latter being disposed downstream of the heat exchange elements that are connected to operate as condensers when viewed in the direction of flow of the steam.

2. Description of the Prior Art

So-called natural-draft dry cooling towers are known that have heat exchange elements through which flows the cooling water of a closed water circuit; the cooling water effects the condensation of the turbine exhaust steam via indirect heat exchange in the condenser. In addition to this indirect system, a direct system is known where the steam is condensed directly in the heat exchange elements of the natural-draft cooling tower. In contrast to the indirect system, this direct system has the advantage of having a greater efficiency due to a greater temperature difference of approximately 2°. With one known configuration of a natural-draft cooling tower of this type, one portion of the heat exchange elements are connected to operate as condensers, and another portion are connected to operate as dephlegmators, reflux condensers or fractionating columns, with the latter being disposed downstream, when viewed in the direction of flow of the steam, from the heat exchange elements which are connected to operate as condensers.

In order with the natural-draft cooling towers of the initially mentioned type to be able to assure a complete condensation of the turbine exhaust steam, the residual condensation must take place in the heat exchange elements that are connected to operate as dephlegmators. At the same time, one must guarantee that the inert gases are completely withdrawn from these heat exchange elements that are connected as dephlegmators. In order to accomplish this, it is important that the heat exchange elements operating as dephlegmators be supplied with a sufficient quantity of cooling air under all load and weather conditions. This is particularly difficult under unfavorable weather conditions, such as strong cross winds and an inversion, i.e., where warm air flows downwardly from above.

An object of the present invention is to improve a natural-draft cooling tower of the aforementioned general type for direct condensation of the turbine exhaust steam in such a way that a complete condensation of the turbine exhaust steam, with residual condensation in the heat exchange elements that are connected to operate as dephlegmators respectively reflux condensers, is effected over the entire range of capacity, even under unfavorable weather conditions.

BRIEF DESCRIPTION OF THE DRAWING

This object, and other objects and advantages of the present invention, will appear more clearly from the following specification in conjunction with the accompanying drawing, which is a schematic vertical sectional view of one embodiment of the inventive natural-draft cooling tower.

SUMMARY OF THE INVENTION

The cooling tower of the present invention is characterized parimarily in that each heat exchange element that is connected to operate as a dephlegmator is provided with a respective fan in a manner known per se.

As a result of the inventive disposition of the fans in the heat exchange elements that are connected to operate as dephlegmators, one is assured even under unfavorable weather conditions that not only is a complete condensation of the turbine exhaust steam effected, but also that the residual condensation is effected in the heat exchange elements that are connected to operate as dephlegmators, so that the inert gases obtained during the condensation are completely withdrawn from these heat exchange elements, even if side winds or an inversion occurs. Furthermore, even if the weather conditions are so favorable that the residual condensation is assured in the heat exchange elements that are connected to operate as dephlegmators, the fans can be used to enhance the natural draft of the cooling tower, for example when the temperature of the cooling air flowing into the cooling tower is extremely high. The energy which has to be expended for the inventive fans is of the order of magnitude of the energy which has to be expended for the pumps of the cooling water circuit of an indirect system; this energy is considerably less than the energy which has to be expended for a direct forced-air cooling system. Furthermore, the increased draft capacity obtained with the fans which are inventively disposed in the heat exchange elements that operate as dephlegmators can be utilized for making the cooling tower smaller than a cooling tower that operates nearly with natural draft; this results in a saving of construction cost.

Pursuant to a further specific feature of the present invention, it is possible to regulate the conveying capacity of the fans. Such regulation can be effected by varying the speed of the drive motors, by adjusting the fan blades at constant speed, or by a combination of these two possibilities. This ability to regulate the conveying capacity provides the possiblity for adapting a natural-draft cooling tower of the aforementioned general type to all weather and load conditions which might occur, and for doing so at slight expense.

DESCRIPTION OF PREFERRED EMBODIMENTS

Referring now to the drawing in detail, the illustrated exemplary embodiment shows a hyperbolic cooling tower shell 1, for example of concrete, which is provided at the bottom with air inlet openings 2, which may be disposed, for example, between the supports of the cooling tower shell 1.

Disposed in one or more planes above the air inlet openings 2 are heat exchange elements generally indicated by reference numeral 3, with the heat exchange elements **3*k* being connected to operate as downflow condensers, whereas the heat exchange elements 3*d* are connected to operate as dephlegmators or reflux condensers. In the illustrated embodiment, for each three heat exchange elements 3*k* that are connected to operate as downflow condensers, a respective heat exchange element 3*d* that is connected to operate as a dephlegmator is provided downstream of the heat exchange elements 3***k* when viewed in the direction of flow of the steam. These four heat exchange elements 3 can be combined with four further heat exchange elements 3 to form a roof-shaped element.

The turbine exhaust steam which is to be condensed is supplied to the natural-draft cooling tower via a central steam line 4. Within the cooling tower, this steam line 4 branches off and is connected via risers 5 to respective ones of the plurality of roof-shaped elements. In each of these elements, the steam is initially supplied from above to the heat exchange elements 3*k* that are connected to operate as downflow condensers, so that the condensate in the preferably finned heat exchange tubes flows in the same direction as does the steam. The residual steam which leaves the heat exchange elements 3*k* is subsequently supplied from below to the associated heat exchange elements 3*d* that are connected to operate as dephlegmators. In the heat exchange elements 3*d*, the condensate flows in a direction opposite to that of the steam, which is completely condensed in the heat exchange elements 3*d*. These heat exchange elements 3*d*, which are connected to operate as dephlegmators, are finally connected via a non-illustrated line to a suction device that completely withdraws the inert gases from the elements.

Viewed as a whole, the heat exchange elements 3, which in the illustrated embodiment are combined to form roof-shaped elements, can, within the cooling tower shell 1, be disposed in a single plane, or can, in a stepped manner, be disposed in a plurality of planes as shown in the drawing. Each of the heat exchange elements 3*d* that is connected to operate as a dephlegmator is provided with its own fan or blower 6, which in the illustrated embodiment are disposed as forced-draft type fans at the base of the roof-shaped heat exchange elements 3*d*.

With the aid of these fans 6, it is possible to increase the quantity of cooling air which flows through the heat exchange elements 3*d* that operate as dephlegmators relative to the quantity of cooling air which flows through the heat exchange elements 3*k* that operate as reflux condensers. In other words, in the region of these heat exchange elements 3*d* it is possible to impart a forced-air cooling to the natural draft effect of the cooling tower shell 1. In the illustrated embodiment, this situation is illustrated in the region of the entry of cooling air into the heat exchange elements 3 with the aid of a flow profile that is indicated above those heat exchange elements 3 shown in section in the drawing. This flow profile shows that the flow velocity of the cooling air through the heat exchange elements 3*d* that are connected to operate as dephlegmators is approximately 50% greater than the flow velocity of cooling air through the heat exchange elements 3*k* that are connected to operate as condensers. As a result, the draft ability of the cooling tower increases, which means that the size of the cooling tower shell 1 can be less than the size of the shell of a cooling tower that operates merely on natural draft.

As a result of the fans 6 that are associated with the heat exchange elements 3*d*, one is assured under all weather and load conditions that a complete condensation of the turbine exhaust steam that is supplied via the central steam line 4 to the cooling tower takes place, and that the residual condensation is effected in the heat exchange elements 3*d* that are connected to operate as dephlegmators, so that the inert gases obtained during the condensation can be completely withdrawn from the heat exchange elements 3. By regulating the conveying capacity of the fans 6, the condensation capacity of the cooling tower can be adapted to the weather and load conditions that exist at any given time. Even if a special ventilation of the heat exchange elements 3*d* that are connected to operate as dephlegmators is not required, the fans 6 can be utilized to enhance the draft of the cooling tower.

The present invention is, of course, in no way restricted to the specific disclosure of the specification and drawing, but also encompasses any modifications within the scope of the appended claims.

What we claim is:

1. In a natural-draft cooling tower having a plurality of preferably roof-shaped heat exchange elements substantially standing rather than lying as arranged for direct heat exchange and for condensing the turbine exhaust steam from a power plant, wherein a portion of said heat exchange elements are connected to operate as condensers, and additionally another portion of said heat exchange elements are connected to operate as reflux condensers, with the latter being disposed downstream, when viewed in the direction of flow of said steam, of said heat exchange elements that are connected to operate as condensers;

the improvement wherein only each of said heat exchange elements that is connected to operate as a reflux condenser is provided with a respective fan installed internally therewith.

2. A cooling tower according to claim 1, in which each of said fans has means to provide a regulatable conveying capacity thereof for the portion of said heat exchange elements connected to operate as reflux condensers.

* * * * *